United States Patent [19]

Bartzick et al.

[11] Patent Number: 4,574,848

[45] Date of Patent: Mar. 11, 1986

[54] DEVICE FOR TENSIONING A STRAPPING BAND POSITIONED AROUND A PACKAGE

[75] Inventors: Gerd Bartzick, Gevelsberg; Gerd Bühne, Schwelm; Jürgen Werk, Wuppertal, all of Fed. Rep. of Germany

[73] Assignee: Hoesch Werke Aktiengesellschaft, Dortmund, Fed. Rep. of Germany

[21] Appl. No.: 519,835

[22] Filed: Aug. 3, 1983

[30] Foreign Application Priority Data

Aug. 11, 1982 [DE] Fed. Rep. of Germany ..... 3229869

[51] Int. Cl.[4] ..... B21F 9/02

[52] U.S. Cl. ..... 140/93.2; 140/123.5

[58] Field of Search ..... 140/93.2, 93.4, 123.5; 100/32; 74/785, 848, 810, 812

[56] References Cited

U.S. PATENT DOCUMENTS

| | | | |
|---|---|---|---|
| 1,815,345 | 7/1931 | Colman | 74/785 |
| 2,593,933 | 4/1952 | Strawn | 74/785 |
| 3,308,686 | 3/1967 | Magg et al. | 74/785 |
| 3,506,041 | 4/1970 | Angarola | 140/93.4 |
| 4,137,788 | 2/1979 | Fischer | 100/32 |
| 4,218,969 | 8/1980 | Kasuga | 100/32 |

*Primary Examiner*—Lowell A. Larson
*Attorney, Agent, or Firm*—Max Fogiel

[57] ABSTRACT

A device for tensioning a strapping band obtained from a supply reel and positioned around a package, and for fastening the overlapping ends of the band together with a sleeveless connection, as well as for cutting off the length of strap not untilized in wrapping the package and leading from the supply reel. A motorized drive mechanism for the upper half of a band-fastening tool and that for the tensioning wheel consists of a single motor that first, while it rotates in one sense, powers a tensioning wheel which tensions the strapping band, and then, subsequent to a shift in gear that depends on the tension in the band, reverses its rotation and powers the shaft of the upper half of the band-fastening tool. The gearshift consists of a pivoting lever that can be shifted against the force of a spring out of its initial position. The pivoting lever engages a spring-loaded gearshift lever through a set screw. The pivot lever is activated by the reaction force of the drive mechanism.

10 Claims, 7 Drawing Figures

DEVICE FOR TENSIONING A STRAPPING BAND POSITIONED AROUND A PACKAGE

Figure 1:
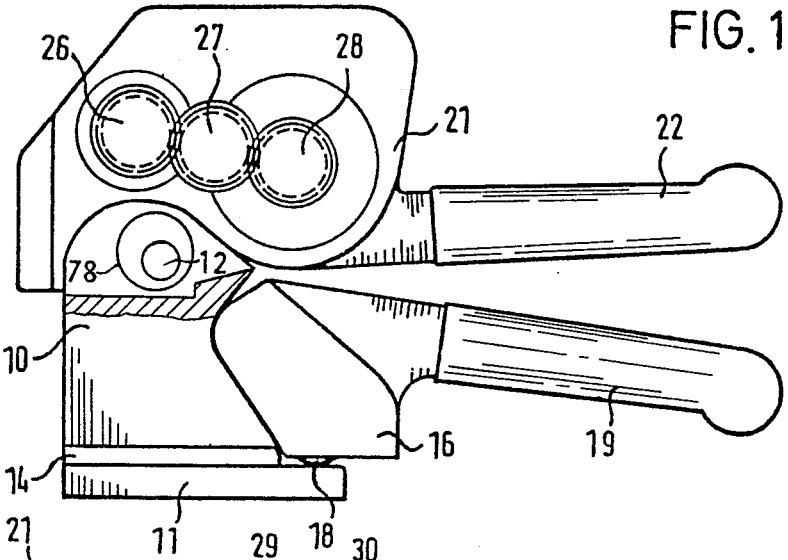

The invention is a device for tensioning a strapping band obtained from a supply reel and positioned around a package, for fastening the overlapping ends of the band together with a sleeveless connection, and for cutting off the length of strap not utilized in wrapping the package and leading from the supply reel, consisting of a housing with a base plate that is applied to the package and that contains the bottom half of the tool that fastens the ends of the band together, the upper half of the tool sliding up and down in the housing and shifted into the operating position by a motorized drive mechanism, the housing having, above the base plate, a slot, through which the ends of the strapping band are introduced from the side between the two halves of the tool that fastens them together and accommodating a tensioning mechanism with a tensioning wheel that engages the top of the overlapping ends of the strapping band and is rotated by a motorized drive mechanism in the tensioning sense, with the motorized drive mechanism for the upper half of the band-fastening tool and that for the tensioning wheel consisting of a single motor that first, while it rotates in one sense, powers a tensioning wheel, which tensions the strapping band, and then, subsequent to a shift in gear that depends on the tension in the band, reverses its rotation and powers the shaft of the upper half of the band-fastening tool.

In known devices of this type, the overlapping ends of the strapping band are forced by a pressure plate against a tensioning wheel in the tensioning mechanism. The pressure plate has a pivoting lever that is spring loaded in the pressure direction and accordingly forces the pressure plate and with it the overlapping ends of the band against the tensioning wheel. The pivoting lever is mounted in such a way that the pressure plate will be forced even more powerfully against the overlapping ends when the tensioning mechanism is employed as intended, meaning when the tensioning wheel rotates, with the pivoting lever carrying out a pivoting motion. This pivoting motion of the lever is exploited to activate the gearshift, which is mounted on the lever and operates in conjunction with an adjustable stop on the housing. When the tensioning mechanism is employed as intended, the pressure plate and hence the pivoting lever are pivoted toward the tensioning wheel until the gearshift with the adjustable stop turns off the switch and stops the motor that powers the tensioning wheel. Thus, this motor is stopped in accordance with how far the lever has pivoted ahd how powerfully the pressure plate has been forced against the tensioning wheel. Still, since the overlapping ends of the band are between the pressure plate and the tensioning wheel, tolerances in the thickness of the band will affect the level of tension that can be obtained in the band. Furthermore, the tensioning wheel and pressure plate have knurls that press into the overlapping ends of the band as the pressure plate is forced toward the tensioning wheel. Differences in the strength of the strapping band that resist the penetration of the knurls into the band also affect the level of tension that can be attained in the band. It is accordingly impossible to repeatedly attain a predetermined level of tension in the strapping band with the known type of device.

The invention is intended as a device of the type initially described that lacks these drawbacks and that can be employed to repeatedly attain a predetermined level of tension in the strapping band.

This objective is attained in accordance with the invention in that the gearshift consists of a pivoting lever that can be shifted against the force of an accumulator out of its initial position, that engages a spring-loaded gearshift lever through a set screw, and that is activated by the reaction force of the drive mechanism. This is a simple means of ensuring that the tension in the strapping band can be raised precisely to the desired level because the reaction force of the drive mechanism will increase with the action force of the drive mechanism to rotate the drive wheel as the tension in the strapping band increases and because the gearshift can be adjusted to turn off the drive mechanism at the instant the desired level of band tension is attained.

The pivoting lever that engages the gearshift lever can be a double-armed lever and be mounted on a shaft, with the reaction force of the drive mechanism acting on one arm of the lever and with the accumulator that is prestressed against the reaction force and the gearshift lever acting on the other arm. This is a simple means of ensuring that one arm of the double-armed lever engages the drive mechanism and is activated by the reaction force, while an accumulator that is directed against the pivoting of the pivoting lever acts on the second arm so that the force of the accumulator must be overcome to pivot the lever before the gearshift lever can shift the motor.

The accumulator can be a helical tension spring that acts on the free end of the second arm of the lever. This spring is a simple means of retaining the pivoting lever in its initial position and of countering the pivoting motion with a certain amount of force.

The gearshift lever can be a double-armed lever and also pivot on the shaft of the pivoting lever, having the set screw in a lateral expansion on one arm over the pivoting lever. Mounting the gearshift lever and the pivoting lever on a common shaft and positioning the set screw in such a lateral expansion simplifies the design.

The arm of the gearshift lever that has the set screw can have a perforation in its free end for attaching a helical tension spring. Thus, the gearshift lever will also be retained in its initial position by a spring that will resist its pivoting motion.

The second arm of the gearshift lever can project in the initial position into the path, parallel to the shaft of the gearshift lever, of a spring-loaded valve, which diverts the compressed air for the motor, and, once it has pivoted into the shift position, can free a path for the spring-activated shifting of the diversion valve. The device will accordingly be activated very simply by a motor powered with compressed air and the gears shifted very simply with a diversion valve, the gearshift lever, once it has shifted into the shifting position, releasing the spring-loaded diversion valve so that it can be shifted subject to its associated spring into the shift position.

A multiple-step, preferably three-step, planetary gear can be associated with the motor that is driven in two senses by compressed air, each step having a sun wheel, planet wheels, a planet carrier, and a wheel with inner teeth, the motor activating the sun wheel in the first step, the planet carrier of the first step the sun wheel of the second step, the planet carrier of the second step the sun wheel of the third step, and the planet carrier of the third step activating the wheel that tensions the strapping band when that planet carrier rotates in one sense and the upper half of the band-fastening tool when it rotates in the other sense. This three-step planetary gear can reduce the speed of the compressed-air motor and accordingly increase its torque. Such a motor is a simple means of obtaining the torque necessary to tension and fasten the strapping band.

The first arm of the pivoting lever that acts on the gearshift lever can engage the cogwheel with internal teeth that is part of the first step and rotates in the housing. When the device is employed as intended, a reaction force will occur in the cogwheel with internal teeth that is part of the first stage and will increase as the corresponding action force of the drive mechanism increases. Since the cogwheel with internal teeth will also rotate in the housing and operates in conjunction with the spring-loaded pivoting lever, the cogwheel will pivot the lever against the force of the associated accumulator and shift the gears. Since the torque in the first step will be relatively low, the reaction force will also be low. A relatively weaker accumulator can therefore be associated with pivoting lever. The moment of shifting can also be precisely set.

The cogwheel with internal teeth that is part of the first step and rotates in the housing can have a recess in its outer surface that accepts the first arm of the pivoting lever. One arm of the pivoting lever will accordingly engage this recess and the lever will pivot when the cogwheel with internal teeth rotates.

A pressure-relief valve in the compressed air line can be associated with the motor that is powered by compressed air. This is a simple means of preventing the motor from overload.

Figure 2:
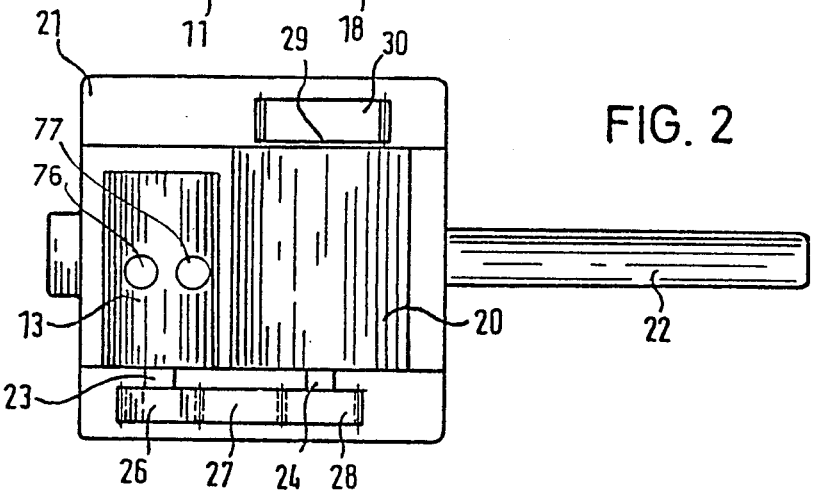
Figure 3:
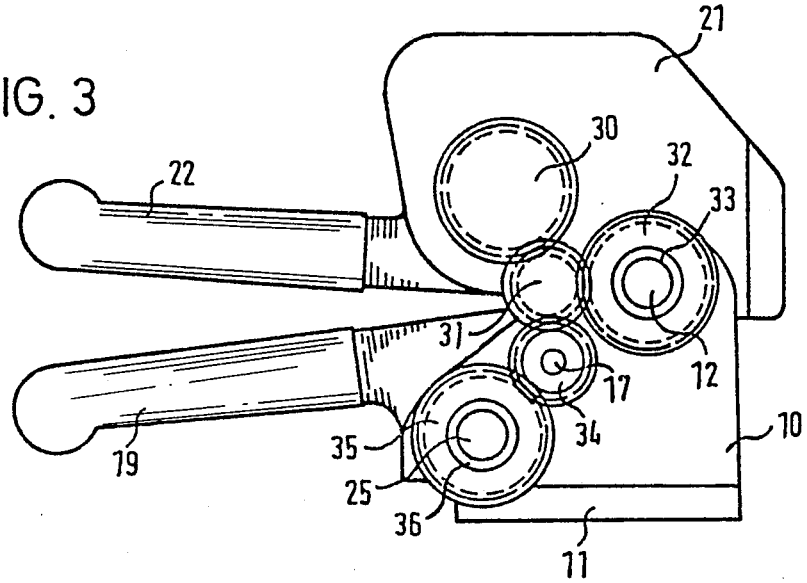
Figure 4:
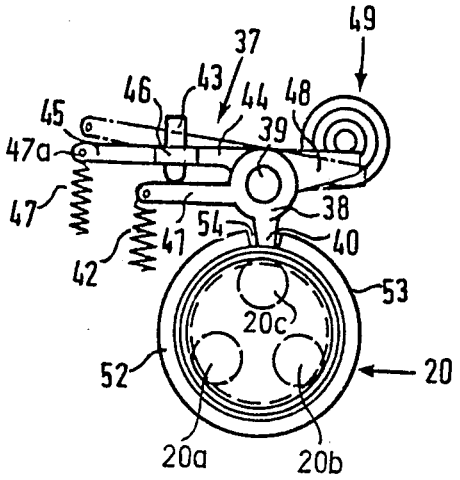
Figure 5:
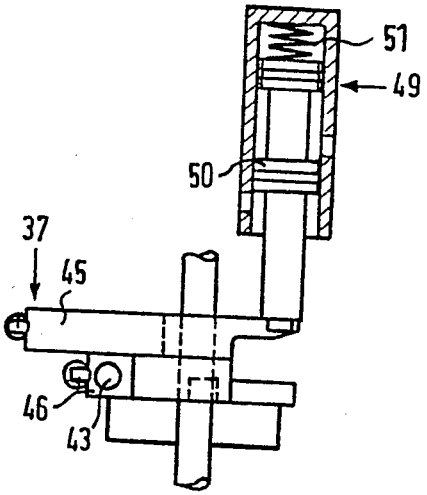
Figure 6:
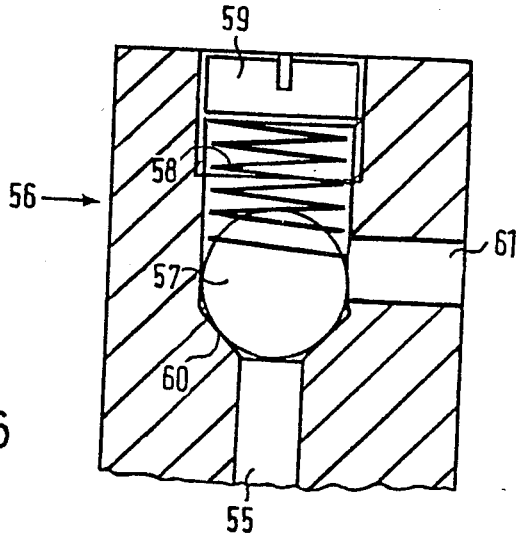
Figure 5A:
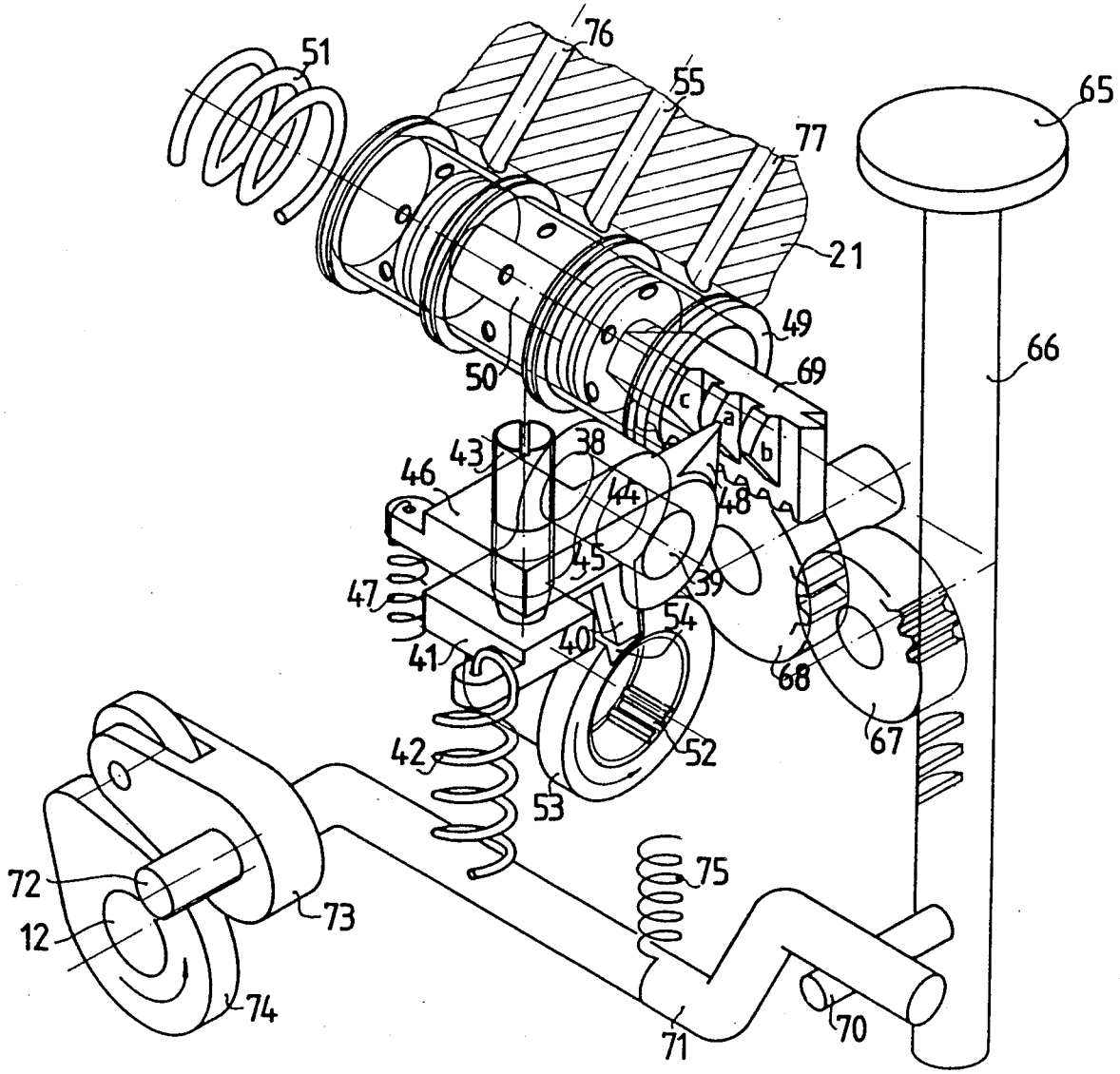

One embodiment of the invention will now be described by way of example with reference to the drawings, in which FIG. 1 is a side view of a device in accordance with the invention, FIG. 2 is a top view of a device in accordance with the invention, FIG. 3 is a rear view of a device in accordance with the invention, FIG. 4 is a side view of the gear-shifting mechanism, FIG. 5 is a top view of the gear-shifting mechanism, FIG. 5*a* is a perspective view of the pneumatic portion of the diversion valve, and FIG. 6 is a section through the pressure-relief valve.

The device illustrated in the drawings is employed to tension a strapping band around a package, neither of which is illustrated, and to fasten the overlapping ends of the band together with a sleeve connection.

As will be evident in particular from FIGS. 1 through 3, the device consists of a housing 10 with a base plate 11 that is applied to the package and that contains the bottom half of the tool that fastens the ends of the band together, the upper half sliding up and down in housing 10. The upper half of the tool is shifted up and down with an eccentric 78 that is mounted on a shaft 12. Shaft 12 is powered as will be described later herein by a motor 13 powered in turn by compressed air through air lines 76, 77.

Housing 10 has, above base plate 11, a slot 14 through which the ends of the strapping band are introduced from the side between the two halves of the tool that fastens them together. Housing 10 also has a pivoting tensioning mechanism 16 in a recess 15. Mechanism 16 is prestressed toward base plate 11 with a spring that is not illustrated. Tensioning mechanism 16 pivots on journal 17 and has a tensioning wheel 18 that engages the top of the overlapping ends of the strapping band. Tensioning wheel 18 is also powered as will be described later herein by the motor 13 powered by compressed air.

Tensioning mechanism 16, which pivots on journal 17, has a handle 19 that can be activated to shift the mechanism against the force of the spring that is not illustrated out of the initial position illustrated in FIG. 1, in which tensioning wheel 18 rests against base plate 11, into a position in which the ends of the strapping band can be introduced. In this band-introduction position, the tensioning wheel 18 of tensioning mechanism 16 is far enough away from base plate 11 to allow the ends of the band to be introduced below tensioning wheel 18.

The device illustrated in the drawings can be used for tensioning a strapping band obtained from a supply reel, which is not illustrated, and positioned around a package, for fastening the overlapping ends of the band together with a sleeveless connection, and for cutting off the length of strap not utilized in wrapping the package and leading from the supply reel. The cutting mechanism is a notching cutter, not illustrated, mounted on the upper half of the fastening tool.

Compressed-air motor 13 is accommodated along with a downstream reduction gear 20 in a special housing 21 on top of housing 10. There is a handle 22 on motor housing 21 and above the handle 19 of tensioning mechanism 16. The operator has access to and can force both handles 19 and 22 together to shift tensioning mechanism 16 into the band-introduction position.

As will be evident in particular from FIG. 2, motor 13 is accommodated in housing 21 next and parallel to reduction gear 20. This makes the design more compact. The rotating shaft 23 of motor 13 parallels the rotating shaft 24 of reduction gear 20, the rotating shaft 25 of tensioning wheel 18, and the shaft 12 of the upper half of the band-fastening tool. The rotary motion of compressed-air motor 13 can be transferred very simply with spur wheels.

There is a pinion 26 on the rotating shaft 23 of motor 13 that is coupled through an intermediate cogwheel 27 with a cogwheel 28 that is rigidly mounted on the rotating shaft 24 of reduction gear 20. Reduction gear 20 is a three-step planetary gear. Each step 20*a*, 20*b*, 20*c* has a sun wheel, planet wheels, a planet carrier, and a wheel with inner teeth, none of which are illustrated. The rotating shaft 24 of reduction gear 20, powered by motor 13, activates the sun wheel in the first step, the planet carrier of the first step the sun wheel of the second step, the planet carrier of the second step the sun wheel of the third step, and the planet carrier of the third step a rotating shaft 29 in reduction gear 20 that carries a cogwheel 30. As will be evident from FIG. 3 in particular, cogwheel 30 powers, through an intermediate wheel 31, another cogwheel 32 that is mounted with a one-way coupling 33 on the shaft 12 of the upper half of the band-fastening tool. Intermediate wheel 31 is also engaged by a second intermediate wheel 34 that rotates on the journal 17 of tensioning mechanism 16. Intermediate wheel 34 meshes with a cogwheel 35 that is mounted on a one-way coupling 36 on the rotating shaft 25 of tensioning wheel 18.

When the device in accordance with the invention is employed for its intended purpose, the first operation is to tension the strapping band. Tensioning wheel 18 is accordingly started up with motor 13 before the overlapping ends of the band are fastened together. Compressed air motor 13, which can be reversed, is therefore driven in one of its senses, powering the cogwheel 32 mounted on one-way coupling 33 on shaft 12. Cogwheel 32, however, rotates in a sense that will not entrain the shaft 12 of the upper half of the band-fastening tool. Once the strapping band has been tensioned as desired, motor 13 is reversed as will be described later herein. The shaft 12 of the upper half of the band-fastening tool is now entrained through one-way coupling 33 by cogwheel 32 on shaft 12. With the drive mechanism rotating in this sense, cogwheel 35, which is associated with tensioning wheel 18, will also rotate, whereas the rotating shaft 25 of tensioning wheel 18 will not be entrained through one-way coupling 36. Another one-way coupling, not illustrated, can also be be associated with the rotating shaft 25 of tensioning wheel 18 to prevent the wheel from rotating backwards. Thus, when motor 13 rotates in one sense, it powers tensioning wheel 18 and, when it rotates in the other sense, the shaft 12 of the upper half of the band-fastening tool.

Motor 13 is shifted automatically from one sense to the other in accordance with the tension prevailing in the strapping band or, in other words, on the torque of the drive mechanism that is needed for further tensioning. FIGS. 4 and 5 illustrate the shift mechanism in greater detail. Gearshift 37 consists of an angled lever 38 that pivots on a shaft 39. The shorter arm 40 of angled lever 38 is acted on as will be described later herein by the reaction force of reduction gear 20, whereas a helical tension spring 42 is attached to the longer arm 41 of angled lever 38. Angled lever 38 pivots out of the initial position illustrated in FIG. 4 against the force of helical tension spring 42. The longer arm 41 of angled lever 38 acts through a set screw 43 on a gearshift lever 44 that also pivots on shaft 39. Gearshift lever 44 has an arm 45 that parallels the longer arm 41 of angled lever 38 and that has an expansion 46 above the lever. Set screw 43 is screwed into a a threaded hole, not illustrated, in expansion 46. Another helical tension spring 47 is attached 47*a* to the free and of the first arm 45 of gearshift lever 44, which pivots against the force of spring 47 out of the initial position represented by the solid lines in FIG. 4 into the shift position represented by the broken lines.

Thus, both lever arms 37 and 38, which are also designated as 45 and 48, are necessary, so that a fine adjustment can be made through the setting screw 43. When the fine adjustment is to be discarded, then only the lever arm 45 is needed. The perpendicular or vertical lever 40 can be welded onto the lever arm 45. Part 46 projects sidewise out of arm 45, so that set screw 43 is located directly over the angle lever 38 and is seated with its point on the upper side thereof.

The second arm 48 of gearshift lever 44 projects in the initial position into the path, parallel to the shaft 39 of gearshift lever 44, of a spring-loaded valve 49, which diverts the compressed air for motor 13, and, once it has pivoted into the shift position, frees a path for the spring-activated shifting of diversion valve 49. The piston 50 of diversion valve 49 is simultaneously subject to a helical compression spring 51 that displaces it into the shift position.

As mentioned in the foregoing, gearshift 37 is activated by the reaction force of the drive mechanism. The first-step cogwheel 52 with internal teeth in drive-mechanism housing 21 has a recess 54 in its outer surface 53 that accepts the shorter arm 40 of angled lever 38. When the device is employed for its intended purpose, the force of the drive mechanism needed to continue tensioning the strapping band increases until the reaction force in the cogwheel 52 with internal teeth in the first step also increases. This reaction force increases to such an extent as tensioning increases that angled lever 38 shifts against the force of helical tension spring 42, and subsequently gearshift lever 44 as well, against the force of helical tension spring 47, into the shift position in which helical compression spring 51 forces piston 50 out of the initial position illustrated in FIG. 5, reversing the rotation of motor 13. Gearshift 37 accordingly enables precise adjustment of the tension that must be generated in the strapping band to shift motor 13 and fasten the overlapping ends of the strap together.

The tension in the strapping band can be varied with set screw 43.

A pressure-relief valve 56 can be mounted in compressed air line 55 to avoid overloading motor 13. Pressure-relief valve 56 has a ball 57 that is subject to a helical compression spring 58. An adjustable screw 59 resting against the rear end of spring 58 regulates its tension. Screw 58 forces ball 57 against a seat 60, blocking the compressed air line 55 to motor 13. When the pressure in line 55 gets too high, the ball 57 of valve 56 is lifted off seat 60 against the force of helical compression spring 58, diverting the air out through line 61. Since pressure-relief valve 56 prevents overloads, the device is easier to handle.

FIG. 5*a* shows a possible construction, that is known in the art, for the pneumatic part of the diversion or switching valve 49. This pneumatic switching valve in FIG. 5*a* has a sleeve 49 which is located in a bore in the housing 21. The outside diameter of the sleeve 49 carries four stages with sealing rings which lie in the bore of the housing 21. The piston 50 with two sealing rings in the bore of the sleeve 49 prevent the air pressure in the line 55 from streaming to the bores 76 to 77.

In the position illustrated, the left bottom or base of the piston 50 lies against the helical compression spring 51 and compresses this spring. At the other side, the piston head 50 carries the gear rack or gear rod 69 which is firmly connected with the piston head 50. The gear rack or tooth rack 69 carries the cornered edges or projections "a", "b", and "c".

The lever 44 holds with the lever arm 48 the toothed rack 69 with piston head 50 in the position illustrated. The teeth of the rack 69 extend into the toothed or gear pinion II 68. The latter pinion mates with the pinion I 67. The pinion 67 drives the toothed rack or rod 66 which is connected with the setting head 65. At its lower end, the toothed rod 66 carries the bolt 70. The lever 71 is arranged transverse to this bolt 70, and is pivotably held about the axis 72. The roll lever 73 is firmly connected to the lever 71. The helical tension spring 75 provides that the roller on the roller lever 73 comes into contact with the cam 74. The cam disk 74 is mounted on the shaft 12.

FIG. 5*a* illustrates the O-position.

In operation of the tensioning or setting procedure, the operator actuates the setting head 65 and thereby moves the toothed rod 66 vertically downward. As a result of the displacement of the toothed rod 66, the pinions 67 and 68 are rotated and move the piston 50 through the toothed rack 69 against the spring 51.

During this displacement motion, the rounded-off back side of the corner projection "b" presses against the lever 48, whereby this lever 48 pivots about the axis 39 and releases the corner projection "b".

As soon as the lever 48 reaches the shop front edge of the projection "b", the lever pivots again about the axis 39 and comes into contact with the front side of the projection "b" and thereby the toothed rack 69 with piston 50 are fixed in place.

Through this position of the piston 50, there is attained the condition that the air pressure flows out of line 55 and into the interior of the sleeve 49 through the bores arranged at the periphery of the valve sleeve 49. From there, the flow is into line 76 which leads to the pneumatic motor 13, so that the motor can carry out the setting or tensioning procedure.

As soon as the motor torque appears, the reaction torque of the first stage of the reduction gear 20 tries to rotate the internal gear 52 in the direction of the arrow. This rotational motion is prevented by the lever arm 40 which extends into the recess 54 of the outer covering surface 53 of the gear 52.

Upon increase in the torque, the angle lever 38 which is connected with the lever arm 40 rotates about the axis 39 and tensions the spring 42. Depending on whether the setting screw 43 lies on the lever arm 41 or is spaced from this lever arm, the lever 44 is moved by the angle lever 38, at reduced or increased motor torque, until the point at which the lever arm 48 releases the projection "b" of the toothed rack 69.

In the closure procedure, the piston 50 is moved together with the toothed rack 69 in the opposite direction with the aid of compression spring 51, until the lever 48 abuts against the corner projection "c" of the toothed rack 69.

During this motion, the motor line 76 becomes interrupted, so that the motor 13 is stopped. Upon further displacement of the piston 50, the line 77 is supplied with air pressure, whereby the motor operates in the reverse direction and carries out the closure process.

During this motion of the toothed rack 69, described immediately above, the toothed rod 66 is raised by the pinions 68 and 67.

After the closure procedure of the tool, the cam disk 74 which is mounted on the same shaft with the eccentric 78, actuates the roller lever 73. The lever 73, thereby, rotates about the axis 72 and moves the lever 17 downward, so that the lever 71 can move again the tooth rod 66, through the bolt 70, in the initial position that is illustrated.

We claim:

1. Apparatus for tensioning a strapping band obtained from a supply reel and positioned around a package, for fastening the overlapping ends of the band together with a sleeveless connection, and for cutting off the length of strap not utilized in wrapping the package and leading from the supply reel, comprising: a housing with a base plate applied to the package and containing the bottom half of a tool fastening the ends of the band together, said tool having an upper half sliding up and down in the housing; motorized drive means connected to said tool for shifting said tool into operating position; said housing having a slot above the base plate, the ends of the strapping band being introduced through said slot from a side between two halves of the tool that fastens them together; tensioning means with a tensioning wheel above said base plate and engaging top of the overlapping ends of the strapping band and being rotated by said motorized drive means in a tensioning direction, said motorized drive means for the upper half of said band-fastening tool and also for said tensioning wheel comprising a single motor that when first rotating in one direction drives said tensioning wheel for tensioning the strapping band, said motor thereafter reversing in direction of rotation upon a shift in gear depending on the tension in the band, and driving a shaft of said upper half of the band-fastening tool; gearshift means adjacent said motor for carrying out said gear shift and comprising: a pivoting lever and spring means connected to said pivoting lever, said pivoting lever being shiftable against the force of said spring means out of its initial position, a spring-loaded gearshift lever engaged by said pivoting lever through a set screw, said gearshift means being activated by a reaction force of said drive means; an arm on said pivoting lever; a gear with internal teeth in said drive means and having a recess in its outer surface engaging said arm on said pivoting lever, said gear with internal teeth executing substantially small angular displacements to reduce actuation of said arm; valve means for controlling said motor, only part of a reaction force acting on said arm of said pivoting lever being used for switching said valve means to maintain thereby switching of said valve means substantially constant.

2. Apparatus as defined in claim 1, wherein said pivoting lever engaging said gearshift lever is a double-armed lever mounted on a shaft, said spring means being prestressed against said reaction force, said gearshift lever acting on one arm of said double-armed lever.

3. Apparatus as defined in claim 1, wherein said gearshift lever is a double-armed lever and pivots on a shaft of said pivoting lever, said set screw being in a lateral expansion on one arm over the pivoting lever.

4. Apparatus as defined in claim 1, wherein an arm of said gearshift lever has said screw and has a perforation in its free end for attaching a helical tension spring.

5. Apparatus as defined in claim 1, including a multiple-step planetary gear associated with said motor, said motor being driven in two directions by compressed air; each step of said gear having a sun wheel, planet wheels, a planet carrier, and a wheel with inner teeth; said motor activating the sun wheel in a first step, the planet carrier of the first step activating the sun wheel of a second step, the planet carrier of the second step activating the sun wheel of a third step, the planet carrier of the third step activating the wheel tensioning the strapping band when that planet carrier rotates in one direction and the upper half of the band-fastening tool when it rotates in the other direction.

6. Apparatus as defined in claim 5, wherein said arm of said pivoting lever engages said gear with internal teeth through said recess, said gear being part of the first step and rotating in the housing.

7. Apparatus as defined in claim 1, including a pressure-relief valve in a compressed air line associated with said motor, said motor being driven by compressed air.

8. Apparatus as defined in claim 1, wherein said valve means comprises a spring-loaded valve, said gearshift lever having an arm projecting in an initial position into a path of said spring-loaded valve parallel to a shaft of the gearshift lever, said spring-loaded valve diverting compressed air for said motor, said gearshift lever when pivoted into a shift position freeing a path for the spring-activated shifting of said valve.

9. Apparatus for tensioning a strapping band obtained from a supply reel and positioned around a package, for fastening the overlapping ends of the band together with a sleeveless connection, and for cutting off the length of strap not utilized in wrapping the package and leading from the supply reel, comprising: a housing with a base plate applied to the package and containing the bottom half of a tool fastening the ends of the band together, said tool having an upper half sliding up and down in the housing; motorized drive means connected to said tool for shifting said tool into operating position; said housing having a slot above the base plate, the ends of the strapping band being introduced through said slot from a side between two halves of the tool that fastens them together; tensioning means with a tensioning wheel above said base plate and engaging top of the overlapping ends of the strapping band and being rotated by said motorized drive means in a tensioning direction, said motorized drive means for the upper half of said band-fastening tool and also for said tensioning wheel comprising a single motor that when first rotating in one direction drives said tensioning wheel for tensioning the strapping band, said motor thereafter reversing in direction of rotation upon a shift in gear depending on the tension in the band, and driving a shaft of said upper half of the band-fastening tool; gearshift means adjacent said motor for carrying out said gear shift and comprising: a pivoting lever and spring means connected to said pivoting lever, said pivoting lever being shiftable against the force of said spring means out of its initial position, a spring-loaded gearshift lever engaged by said pivoting lever through a set screw, said gearshift means being activated by a reaction force of said drive means; an arm on said pivoting lever; a gear with internal teeth in said drive means and having a recess in its outer surface engaging said arm on said pivoting lever, said gear with internal teeth executing substantially small angular displacements to reduce actuation of said arm; valve means for controlling said motor, only part of a reaction force acting on said arm of said pivoting lever being used for switching said valve means to maintain thereby switching of said valve means substantially constant; said pivoting lever engaging said gearshift lever being a double-armed lever mounted on a shaft, said spring means being prestressed against said reaction force, said gearshift lever acting on one arm of said double-armed lever; said spring means being a helical tension spring acting on the free end of said other arm of the pivoting lever; said gearshift lever being a double-armed lever and pivoting on a shaft of said pivoting lever, said set screw being in a lateral expansion on one arm of the pivoting lever; an arm of said gearshift lever having a perforation for attaching said helical tension spring; said valve means comprising a spring-loaded valve, said gearshift lever having an arm projecting in an initial position into a path of said spring-loaded valve parallel to said shaft of the gearshift lever, said spring-loaded valve diverting compressed air for said motor, said gearshift lever when pivoted into a shift position freezing a path for the spring-activated shifting of said valve; a multiple-step planetary gear associated with said motor, said motor being driven in two directions by compressed air; each step of said gear having a sun wheel, planet wheels, a planet carrier, and a wheel with inner teeth; said motor activating the sun wheel in a first step, the planet carrier of the first step activating the sun wheel of a second step, the planet carrier of the second step activating the sun wheel of a third step, the planet carrier of the third step activating the wheel tensioning the strapping band when that planet carrier rotates in one direction and the upper half of the band-fastening tool when it rotates in the other direction; said arm of said pivoting lever engaging said gear with internal teeth through said recess, said gear being part of the first step and rotating in the housing; and a pressure-relief valve in a compressed air line associated with said motor.

10. Apparatus as defined in claim 2, wherein said spring means is a helical tension spring acting on the free end of said other arm of the pivoting lever.

* * * * *